US005940089A

United States Patent [19]

Dilliplane et al.

[11] Patent Number: 5,940,089

[45] Date of Patent: Aug. 17, 1999

[54] METHOD AND APPARATUS FOR DISPLAYING MULTIPLE WINDOWS ON A DISPLAY MONITOR

[75] Inventors: Stephen C. Dilliplane, Yardley; Gary J. Lavelle, Newtown; James G. Maino, Exton; Richard J. Selvaggi, Doylestown; Jack Tseng, New Hope, all of Pa.

[73] Assignee: ATI Technologies, Canada

[21] Appl. No.: 08/747,090

[22] Filed: Nov. 12, 1996

Related U.S. Application Data

[60] Provisional application No. 60/006,650, Nov. 13, 1995.

[51] Int. Cl.[6] ..... G09G 5/36

[52] U.S. Cl. ..... 345/515; 345/507; 345/439; 345/153

[58] Field of Search ..... 345/439, 127, 345/501, 502, 507–509, 515, 153

[56] References Cited

U.S. PATENT DOCUMENTS

| | | | |
|---|---|---|---|
| 4,868,557 | 9/1989 | Perlman | 345/508 |
| 5,381,347 | 1/1995 | Gery | 345/509 |
| 5,406,306 | 4/1995 | Siann et al. | 345/115 |
| 5,517,612 | 5/1996 | Dwin et al. | 345/507 |
| 5,559,954 | 9/1996 | Sakoda et al. | 345/507 |

*Primary Examiner*—Kee M. Tung

[57] ABSTRACT

A display list contains a plurality of entries which each point to a block of data to be displayed on a display screen. An attribute field associated with each entry defines the type of data in the block, so that the data may be properly processed and converted to a displayable image. The display list allows for multiple windows of different data types to be quickly processed and simultaneously displayed on the display screen.

15 Claims, 8 Drawing Sheets

FIG. 2A

| span entry 158 | AID 148 | LSA 160 | VGA 162 | OFS 164 | SL 166 |
|---|---|---|---|---|---|
| 0 | 0 | 0 | 1 | 0 | 15 |
| 1 | 0 | 32 | 1 | 0 | 15 |
| 2 | 0 | 64 | 1 | 0 | 5 |
| 3 | 1 | 256 | 0 | 1 | 8 |
| 4 | 0 | 76 | 1 | 0 | 3 |
| 5 | 0 | 96 | 1 | 0 | 5 |
| 6 | 1 | 256 | 0 | 1 | 8 |
| 7 | 0 | 108 | 1 | 0 | 3 |
| 8 | 0 | 128 | 1 | 0 | 5 |
| 9 | 1 | 272 | 0 | 1 | 8 |
| 10 | 2 | 1028 | 0 | 0 | 7 |
| 11 | 0 | 160 | 1 | 0 | 5 |
| 12 | 1 | 272 | 0 | 1 | 8 |
| 13 | 0 | 1284 | 0 | 0 | 7 |
| 14 | 0 | 192 | 1 | 0 | 8 |
| 15 | 2 | 1536 | 0 | 0 | 13 |
| 16 | 0 | 224 | 1 | 0 | 8 |
| 17 | 2 | 1792 | 0 | 0 | 13 |

144

FIG. 5C

| attribute identity 148 | DTP 150 | BPP 152 | YSF 154 | XSF 156 |
|---|---|---|---|---|
| 0 | 0 | 0 | 0x000 | 0x000 |
| 1 | 1 | 2 | 0x400 | 0x400 |
| 2 | 0 | 1 | 0x000 | 0x000 |

146a 146b 146c

142

FIG. 5B

METHOD AND APPARATUS FOR DISPLAYING MULTIPLE WINDOWS ON A DISPLAY MONITOR

CROSS-REFERENCE TO RELATED APPLICATION

This application claims the benefit of U.S. Provisional Patent Application No. 60/006,650 filed Nov. 13, 1995 pending.

BACKGROUND OF THE INVENTION

Computers and work stations have become very popular and people have become very adept at using computers for performing a plurality of tasks simultaneously. The processing power and processing speed of personal computers, as well as the software for operating personal computers, has improved dramatically, such that personal computers are now capable of efficiently performing multi-tasking. In order to manage and view a variety of activities executing on the computer simultaneously, operating systems provide a graphical user interface which can display multiple windows of information simultaneously, with each window representing a different process or operation. These display windows may overlap each other, reside side by side, or be moved in any desired manner by the user, so that the user can view, manage and/or interact with each activity being performed by the computer.

Providing multiple windows of information on a video monitor requires a great amount of the host computer or central processing unit's (CPU) resources. Accordingly, special hardware has been designed to off-load the processing of video information from the CPU. Typically, such special hardware or video controllers, receive and process a single type of video information at a time, place the information into a video frame buffer, and then convert the digital information stored in the frame buffer to information (i.e. analog RGB data) which is displayed on the monitor.

FIG. 1A is a schematic functional block diagram of a typical prior art system 10 in which visual data 12 and control information 14 in the form of digital data are received from the host computer (not shown). The control information 14 specifies how the visual data 12 is to be interpreted. The visual data 12 is stored in a frame buffer 16. The visual data 12 could be in different formats, for instance, linear gray scale, RGB, YUV, or palletized color data. Each of these different formats must be translated to a common display format (i.e. RGB) prior to being painted or displayed on a video monitor or display screen 18. The frame buffer 16 is a dynamic memory which stores all of the converted data to be displayed on the screen 18. That is, the frame buffer 16 stores pixel data, which defines how each pixel on the screen 18 will be activated. In this prior art system 10, only one data type can be displayed on the screen 18 at any one time. Thus, even if multiple windows are being displayed on the screen 18, each window is of the same data type. For instance, pixel data is commonly displayed in RGB, YUV, VGA, or linear gray scale mode, and the prior art permits painting windows of data on a screen in only one of these modes at a time. In addition, all of the visual data 12 is stored in sequential memory locations in a contiguous memory space in either the video controller and/or the host processor. Further, the frame buffer addressing logic (which controls the frame buffer pointer) is rudimentary, in that the pointer is simply incremented from one frame buffer address to the next, until it reaches the end of the buffer 16, at which time the pointer is reset to point to the beginning of the frame buffer 16.

With the advances in computer and software technology, there was a need for being able to quickly and efficiently display more than one type of data on the display screen 18. For instance, it was desired to display a digital graphics image in a first window and a live video image in a second window, simultaneously, on the screen 18.

FIG. 1B is a functional schematic block diagram of another prior art system 20 in which a digital graphics image A is displayed in a first window on the screen 18 and a digital video image B is displayed in a second window on the screen 18. According to this system 20, digital graphics information is stored in a first portion 22 of a display memory 24 and digital video data is stored in a second portion 26 of the display memory 24. Due to the fact that the digital graphics information and the digital video information are formatted differently, control logic 28 is provided to convert the two different data types to a common format before storing the information in the frame buffer 16. In addition, a separate, additional buffer 30 is provided for reading the digital video information out of the memory 24 in order to synchronize the graphics information and the video information because these two information types are read out of the memory 24 at different frequency rates.

Although the prior art system 20 allows for displaying a video window B and a graphics window A simultaneously on the screen 18, the system 20 still only processes and displays data which is provided from sequential memory locations of the display memory 24. That is, there is a one-to-one correspondence between the data displayed on the screen 18, the data in the video RAM or frame buffer 16 and the data in the display memory 24. Accordingly, like the system 10, the system 20 takes a hardware approach to addressing the pixel data in the frame buffer 16. Further, the system 20 is limited in the number of windows that can simultaneously be displayed and the number of data types which can be simultaneously displayed on the screen 16. Accordingly, there exists a need to be able to simultaneously display a plurality of windows of different data types or display formats, as well as the ability to perform window clipping and foreground to background switching on the screen 18. There also is a need to be able to manage and store, in both real-time and nonreal-time, the data representing the different windows more efficiently. There further is a need to be able to quickly move and rearrange windows displayed on the screen 18.

The present invention enables multiple windows of different types or formats to be simultaneously displayed on a monitor or display screen, such as a computer monitor. Further, the multiple windows may overlap each other in any desired manner and be quickly rearranged and repainted on the screen. In addition, the present invention allows more than one stream of pixel data to be fetched at a time, from anywhere in memory, as opposed to the prior art, which allowed fetching only one pixel stream from a single, linear block of memory.

The present invention provides a soft approach to storing, managing, and accessing pixel data stored in the video memory or frame buffer. A layer of addressing logic is provided which allows pixel information to be stored randomly, in nonsequential locations of the frame buffer. According to the invention a linked list, termed a "display list," is used to point to the location of the information displayed on the monitor or screen. For instance, a first window is stored in a first block of memory, a second window in a second block of memory, etc. Each window may be of any size and shape, and accordingly, each block of memory required to store the window data may vary.

Further, the window data need not comprise a single contiguous block of memory, but may be broken up into smaller blocks of memory randomly located throughout the display memory. In contrast, the prior art methods of storing display data requires constantly piecing the display frame together into sequential memory locations by performing multiple destructive writes to the frame buffer. The display list architecture of the present invention is thus a transformation from the "data" domain of the prior art to an "addressing" domain. Although the display list architecture adds a level of logic, i.e. addressing logic, to the control of video data, the benefits afforded by the display list architecture are valuable. For instance, reconstruction of the frame buffer by way of multiple destructive writes in order to compensate for switching a window from background to foreground is no longer necessary. Rather, only the display list, and not the pixel data, needs to be updated. Therefore, no destructive writes are required to display a plurality of windows where the windows are switching from foreground to background. Accordingly, window switching can be performed in real-time, in a fraction of the time it takes the prior art to perform window switching.

In addition to pointing to the information to be displayed on the screen, the display list includes an attribute definition field which defines the type of display information being pointed to by the display list. That is, the display list may point to a first block of data which defines a window of graphics data, a second block of data which defines a window of video data, and a third block of data which defines a window of VGA data. The present invention allows for each of these windows of different types of data to be displayed simultaneously at any desired position on the screen. Further, new windows may be quickly and efficiently displayed merely by changing a display list entry to point to a different block of data, where data for the new window is stored, as opposed to having to read the whole block of data into a video memory, and possibly have to also rearrange all of the data presently in the video memory. As will be apparent, the present invention provides many advantages over prior art methods of storing and processing display information.

BRIEF SUMMARY OF THE INVENTION

Briefly stated, the present invention comprises an apparatus for displaying multiple windows of visual information on a video monitor. A first memory means for storing an attribute table is provided. The attribute table includes a plurality of attribute entries, each such attribute table entry defines a manner by which the visual information is processed. A second memory means for storing a span table is provided. The span table includes a plurality of span table entries, each such span table entry defines a display window. Means for reading a current attribute entry from the first memory means are provided. Means for reading a current span entry from the second memory means are provided. Means for fetching display window pixel information from a memory location specified by the current span entry are provided. Means for processing the fetched pixel information in the manner specified by the current attribute entry and means for presenting the processed pixel information for display on the video monitor are provided.

The present invention also provides a method for describing multiple windows of pixel data to be displayed on a display monitor comprising the steps of:

defining an attribute list describing different simultaneously displayed data types and pixel attributes;

defining a display list describing a pixel data fetching pattern;

processing a first display list entry to identify a memory address of a first pixel and a last pixel defined by the first display list entry;

fetching from memory the pixel data stored in the memory addresses defined by the first display list entry;

further processing the first display list entry to obtain display list attributes associated with the first display list entry;

passing the display list attributes and the fetched pixel data to a display controller; and the display controller interpreting the pixel data and the display list attributes to paint the pixel data on the monitor in the manner specified by the attributes.

The present invention further provides a method of displaying multiple windows of information on a display monitor comprising the steps of:

providing a dynamic memory containing a plurality of blocks of data to be displayed on the display monitor;

defining a display list having a plurality of display list entries, each display list entry pointing to one of the blocks of data to be displayed on the display screen;

providing attribute information along with each display list entry for defining how each respective block of data is processed;

reading each display list entry in the display list;

reading each block of data pointed to by a display list entry;

processing each block of data according to the attribute information corresponding thereto; and painting the display monitor with the processed blocks of data.

BRIEF DESCRIPTION OF SEVERAL VIEWS OF THE DRAWINGS

The following description of preferred embodiments of the invention will be better understood when read in conjunction with the appended drawings. For purposes of illustrating the invention there are shown in the drawings embodiments which are presently preferred. However, the invention is not limited to the particular arrangements and instrumentalities disclosed. In the drawings:

FIG. 5B is a schematic diagram of an attribute list defining the three individual windows shown on the portion of the video monitor of FIG. 5A;

FIG. 5C is a schematic diagram of a span table defining the three individual windows shown on the portion of the video monitor of FIG. 5A;

FIG. 9C is a schematic diagram showing the three scan lines of FIG. 9A scaled in accordance with a preferred embodiment of the present invention.

DETAILED DESCRIPTION OF THE INVENTION

The present invention is directed to a video controller which provides hardware support to a host computer for displaying visual information on a video monitor. The present invention allows for a plurality of windows to be displayed simultaneously on a video monitor. The present invention allows pixel data for each of the individual windows to be randomly located in memory, as opposed to being required to be sequentially located in memory. Further, the data displayed in each of the individual windows may be derived from pixel information which is interpreted differently from the pixel information in the other windows. That is, one window may be displaying typical RGB information, a second window may be displaying YUV information and a third window may be displaying linear gray scale information. Although the present embodiment of the invention provides specific hardware components to support displaying multiple, independent windows on a video monitor, it will be understood by those of ordinary skill in the art that certain aspects of the invention implemented in hardware could also be implemented primarily using software, and so the present embodiment is but one illustration of the invention.

Figure 1A:
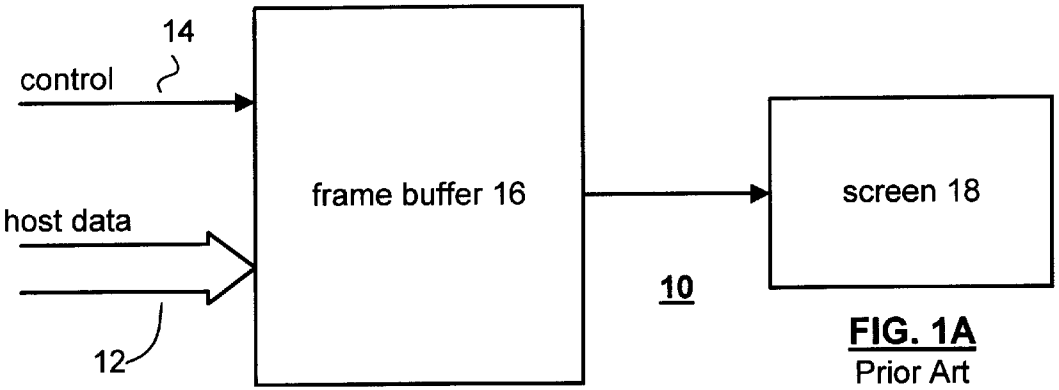
FIG. 1A Prior Art
FIG. 1A is a schematic functional block diagram of a first prior art means for providing display information to a video monitor.
Figure 1B:
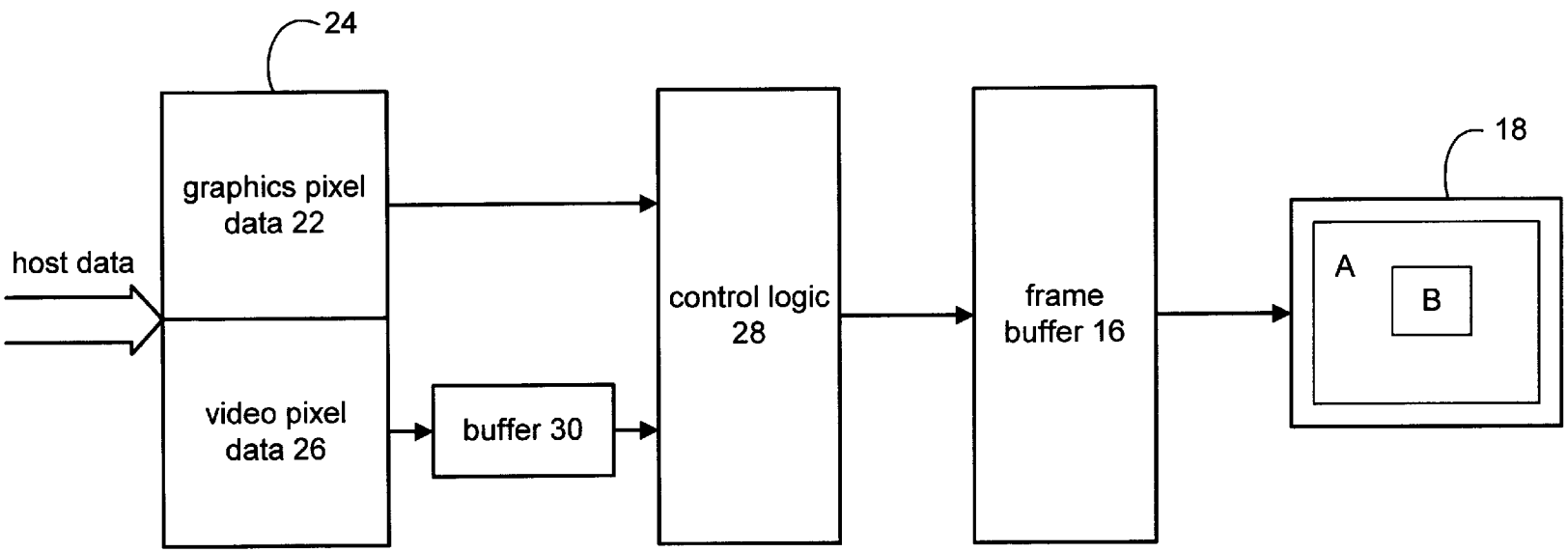
FIG. 1B Prior Art
FIG. 1B is a schematic functional block diagram of a second prior art means for providing display information to a video monitor.
Figure 2A:
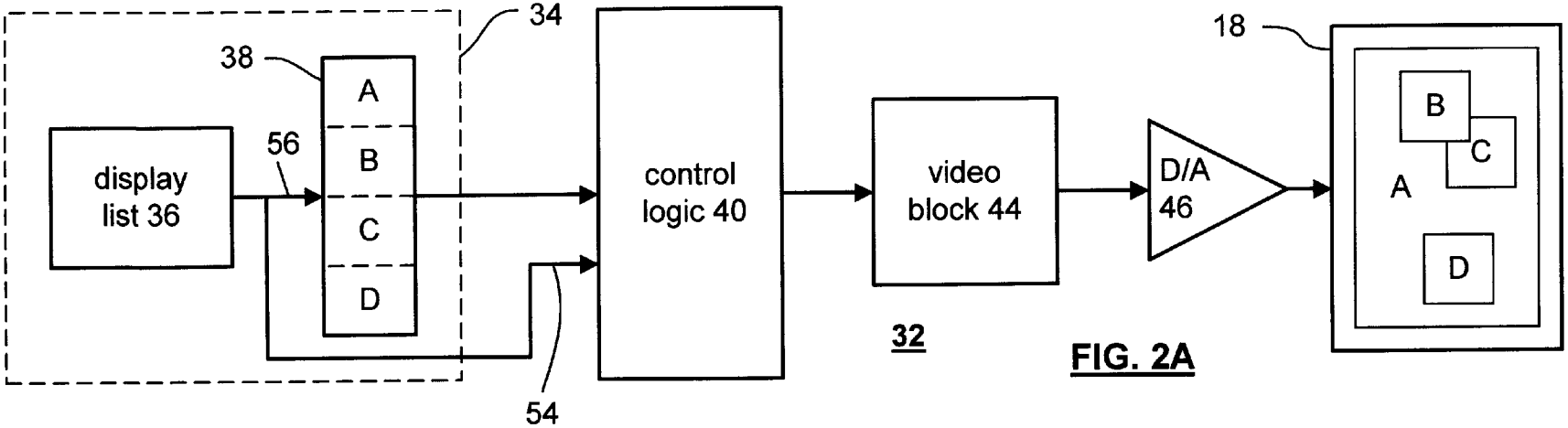
FIG. 2A is a schematic functional block diagram of a means for providing display information to a video monitor in accordance with a preferred embodiment of the present invention.

Referring now to the drawings, wherein like numerals indicate like elements throughout, FIG. 2A is a schematic functional block diagram of a system, generally denoted 32 for simultaneously displaying multiple windows of different data types on the video monitor or display screen 18. The system 32 comprises a memory 34 for storing a display list 36 and display information or pixel data 38. The memory 34 is preferably a dynamic memory, such as a RAM located in a video graphics controller. Alternatively, the memory 34 could be a set of registers or a cache memory associated with a host processor. It will be apparent to those of ordinary skill in the art that the display list 36 could also be located in other locations of a memory associated with or accessible by a host processor or graphics controller and also that the pixel data 38 could be located in a separate memory. In the presently preferred embodiment, the display list 36 resides in an off-screen video memory (not shown). In addition to the memory 34, the system 32 comprises a control logic block 40, a display controller or video block 44 and a digital-to-analog converter (DAC) block 46, each described in more detail hereinafter.

The display list 36 enables multiple display windows, indicated at A, B, C and D on the screen 18, to be displayed and/or overlaid on each other. In addition, the display list 36 allows for each display window A, B, C, D to be of a different data type, such RGB data, YUV data, linear gray scale data, or palletized color data, as well as variations of each data type, which are known by those of ordinary skill in the art, and for each of the windows A, B, C, D to be of arbitrary size and shape. The system 32 permits different X scaling, Y scaling, pixel depths, and RGB to YUV conversion for several windows at a time. The display list 36 also permits live video data to be displayed in several windows at the same time. For instance, a plurality of windows A, B, C, and D are shown on the display screen 18. Window A is a background window, windows C and D are in the foreground, and window B, also in the foreground, in addition to overlapping window A, also overlaps window C. Although each of the windows is depicted as rectangular, the windows may be of any size and/or shape, such as circular. Further, although four windows are shown, the system 32 is not limited to simultaneously displaying four windows, as more or less windows may be simultaneously displayed.

The display list 36 provides an alternative to the sequential frame buffer organizations supported in the prior art. Image information displayed on the display screen 18 is represented by pixel data, which indicates how each pixel on the display screen 18 is activated. The display list 36 specifies both the source of the pixel data and the interpretation of the pixel data displayed on the screen 18. That is, the display list 36 defines where all of the pixel data required to display the windows A, B, C, D on the screen 18 is located in the memory 34.

Figure 2B:
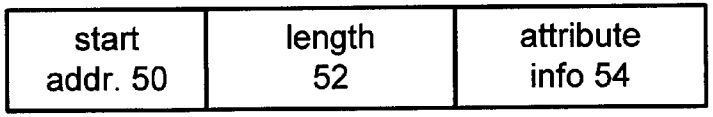
FIG. 2B is a schematic block diagram of a display list entry in accordance with a preferred embodiment of the present invention.

Generally, the display list 36 comprises a table of display list entries. A typical display list entry 48 is shown in FIG. 2B. The display list entry 48 comprises a starting address 50, a span length 52 and attribute information 54. The starting address 50 specifies the starting address of a block of the pixel data 38 to be read from any location within the memory 34. The span length 52 specifies the size or length of the block of the pixel data 38 which begins at the starting address 50. That is, the combination of the starting address 50 and the span length 52 define the location and size of a block of the pixel data 38 to be displayed. The attribute information 54 specifies how the block of pixel data defined by the starting address 50 and the span length 52 is to be interpreted or processed prior to being displayed on the display screen 18. For instance, although the present embodiment is discussed mainly in terms of simultaneously painting or displaying windows of different data types on the screen 18, the attribute information can also include information pertaining to texture mapping, monitor identification, and teleconferencing. The display list 36 will thus be understood by those of ordinary skill in the art from this disclosure to provide an architectural framework for providing a plurality of features. The display list 36 implements address pointing to video data, as opposed to sequentially accessing display memory. Further, the display list 36 architecture is expandable, such that a display list may point to another display list (i.e. display lists 36 may be nested). That is, a display list 36 will point to a second display list, with the second display list pointing to a block of video data. Thus, a display list 36 can provide indirect addressing of blocks of video data. In other words, the display list 36 can be thought of as an addressable object, with the object being a block of the display information or pixel data 38.

Referring again to FIG. 2A, a plurality of windows, specified as A, B, C, and D are displayed on the video monitor or screen 18. The display list 36 points to individual blocks of the video pixel data 38 located in the memory 34. Each window A, B, C, D comprises a separate block of sequential locations, indicated at A, B, C, D in the memory 34. As can be seen, the windows A, B, C, D, do not have to reside in sequential locations in the memory 34 since each display list entry 48 specifies the pointer or starting address 50 and the span length 52 for each window.

The display list 36 can be thought of as a programmable pixel "requester." That is, a program that controls both the source of the raw pixel data put into the memory 34 and the manner in which the pixel data 38 is interpreted to create pixels displayed on the display screen 18. The display list 36 contains information to describe a full frame of display data.

The "commands" of the display list program are called "span entries". A single span entry can specify a contiguous range of pixels in the memory 34 to be sent to the screen 18 along with a pointer to an "attribute entry" which contains information on how the pixels should be formatted. A span can be as long as one full scan line or as short as one pixel.

In operation, the display list entry 48 is read from the display list 36. The display list entry 48 for window A specifies the starting address 50 in the memory 34 where the pixel data 38 for window A resides. The pixel data 38 for window A is thus accessed beginning at starting address 50. As the pixel data 38 is read from the memory 34, the pixel data 38 is passed to the control logic block 40, where the pixel data 38 is interpreted, as specified by the attribute information 54 of the display list entry 48, and then the interpreted data is further processed by the display controller 44 and converted to analog signals by the DAC block 46 prior to being displayed on the screen 18. An address pointer 56 is incremented to access the next memory location, and so on, until the address pointer 56 is equal to the sum of the start address 50 and the span length 52. At that time, the next display list entry 48 is read, which specifies a new starting address 50 and new span length 52. This process is repeated until each display list entry 48 has been read and all of the pixel data 38 specified by the display list 36 has been read, processed, and displayed on the screen 18.

The control logic block 40 interprets the pixel data 38 read from the memory 34 as specified by the display list entry 48 in accordance with the attribute information 54. According to the present invention, various pixel depths, pixel formats, row offsets and scale factors can all be intermixed and simultaneously displayed. The display controller 44 provides pixel format conversion, color space conversion, and scaling of the frame buffer pixel data before the data is presented to the DAC block 46. For instance, the display controller 44 accepts many different input pixel formats, such as 8, 16, 24 and 32 bits of data per pixel, 8 -bit palettized color, true color RGB888, high color RGB565 and RGB555, direct RGB332, YUV444, YUV422, and gray scale, and provides output pixel formats of 24 bit per pixel RGB or 8 bit palettized color. The display controller 44 also supports a variety of color spaces, such as RGB, YUV, grayscale, and palettized. The display controller 44 converts incoming pixels in any of these color spaces to the native RGB color space of the DAC block 46. Input RGB formats 332, 555, 565 or 888 are converted to RGB888 format prior to being presented to the DAC block 46. YUV formats 422 and 444 are also converted to RGB888 format prior to being presented to the DAC block 46. A full description of the format of the various color spaces is not necessary for a complete understanding of the present invention, since the use of the various formats and color spaces is generally well known in the art. Suffice it to say that the display controller 44 is capable of converting each of these formats into a format which can be converted to analog signals by the DAC block 46 and displayed on the video monitor 18.

Thus, as will be appreciated, the display list 36 provides a very powerful method for accessing pixel data 38, in the form of pixel information, such that the pixel data 38 may be located in non-sequential locations of the memory 34. Although the blocks of pixel data 38 are shown located in the same memory 34 as the display list 36, it will be apparent to those of ordinary skill in the art, that the blocks of pixel data 38 may be located in a memory separate from the display list 36, such as a host cache memory, a separate local memory, or an input buffer which stores video or other types of data coming directly from an external source.

Figure 3B:
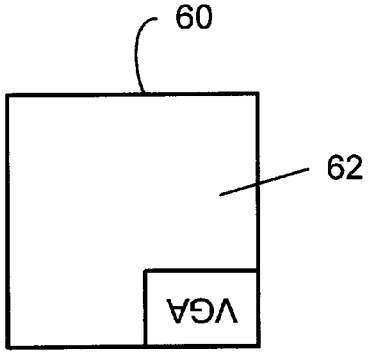
FIG. 3B is a schematic diagram of the video monitor of FIG. 3A with the image displayed in FIG. 3A inverted.
Figure 3A:
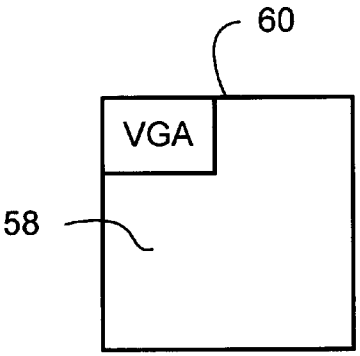
FIG. 3A is a schematic diagram of a video monitor having an image displayed thereon.

In order to illustrate one of the advantages provided by the use of the display list 36 of the present invention, a video image 58 displayed on a video monitor 60 is shown in FIG. 3A. The image 58 includes the type "VGA" in an upper left corner thereof. In order to paint the image 58 on the monitor 60, a frame buffer (not shown) of pixel information must be read and provided to the DAC block 46 (FIG. 2A).

FIG. 3B shows the image 58 displayed in an inverted form 62 on the monitor 60. In the prior art, in order to convert the image 58 to the inverted image 62, an entire frame buffer of data has to be changed prior to repainting the image on the monitor 60. However, according to the present invention, only the display list must be changed in order to paint the inverted image 62 on the monitor 60, and not the entire frame buffer of pixel data. In the presently preferred embodiment, the span table entries of the display list 36 are rewritten in reverse order in the span table in order to display the inverted image 62. However, it will be apparent to those of ordinary skill in the art that other methods of displaying the inverted image 62 are possible using the display list architecture of the present invention. For instance, a bit in the attribute information field 54 of the display list entry 48 could specify to paint the image 58 in inverted form. Then, only one bit need be changed in the display list 36. Alternatively, if the "VGA" is the only portion of the image to be inverted, a display list entry which specifies only the "VGA" portion of the image would have to be changed. Yet another possibility is to change the starting address specified in the span table to the last address of pixel data 38 and provide a negative span length, so that the pixel data 38 is then accessed in reverse order, with the memory address pointer 56 being decremented, as opposed to incremented, thereby accessing the pixel data 38 in reverse order. Thus, it will be apparent to those of ordinary skill in the art that the display list architecture of the present invention provides a very powerful and flexible means of accessing pixel information and is capable of quickly altering the image displayed on a video monitor.

Figure 4:
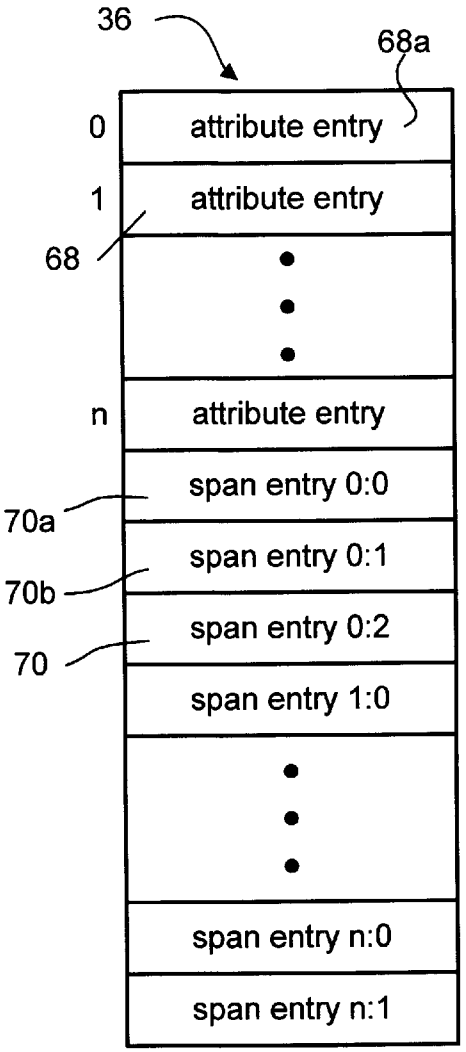
FIG. 4 is a schematic diagram of a display list in accordance with a preferred embodiment of the present invention.

Referring now to FIG. 4, in the presently preferred embodiment, the display list 36 comprises two sections, an attribute table 64 and an address table 66. The attribute table 64 comprises a plurality of entries 68 which contain attribute definitions for individual windows. Each entry 68 contains the attributes for one or more windows. In the presently preferred embodiment, each entry 68 has a width of one double word. The first entry 68*a* is located at a display list base address. There are "n" entries in the attribute table 64. The number of attribute entries 68 specifies the number of different types of windows which may be displayed simultaneously on the video monitor 18.

The address table 66 contains a plurality of address table entries 70 which contain addresses of pixel data to be displayed, plus information on which set of attributes to use. In the presently preferred embodiment, each address table entry 70 has a width of two double words. The first entry 70*a* of the address table 66 is located right after the last entry of the attribute table 64. Since the length of the attribute table 64 is fixed at "n", the first entry 70*a* of the address table 66 is a fixed offset from the display list base address. In displaying an image on the screen 18, i.e. pixel data located in the memory 34, the internal pointer of the address table 66 is reset at the start of each frame and each entry 70 is read and executed in turn. The first piece of pixel data read is located at the start address specified by the first entry 70*a* in the address table 66. As previously discussed, the memory 34 is then read in sequence, until the memory address equals the end address specified by the first entry 70*a*. Then, the internal pointer of the address table 66 is incremented to point to the next entry 70*b*, and so on, until the lower right corner or the end of the screen 18 is reached, whereupon the process is repeated for the next frame.

Figure 6:
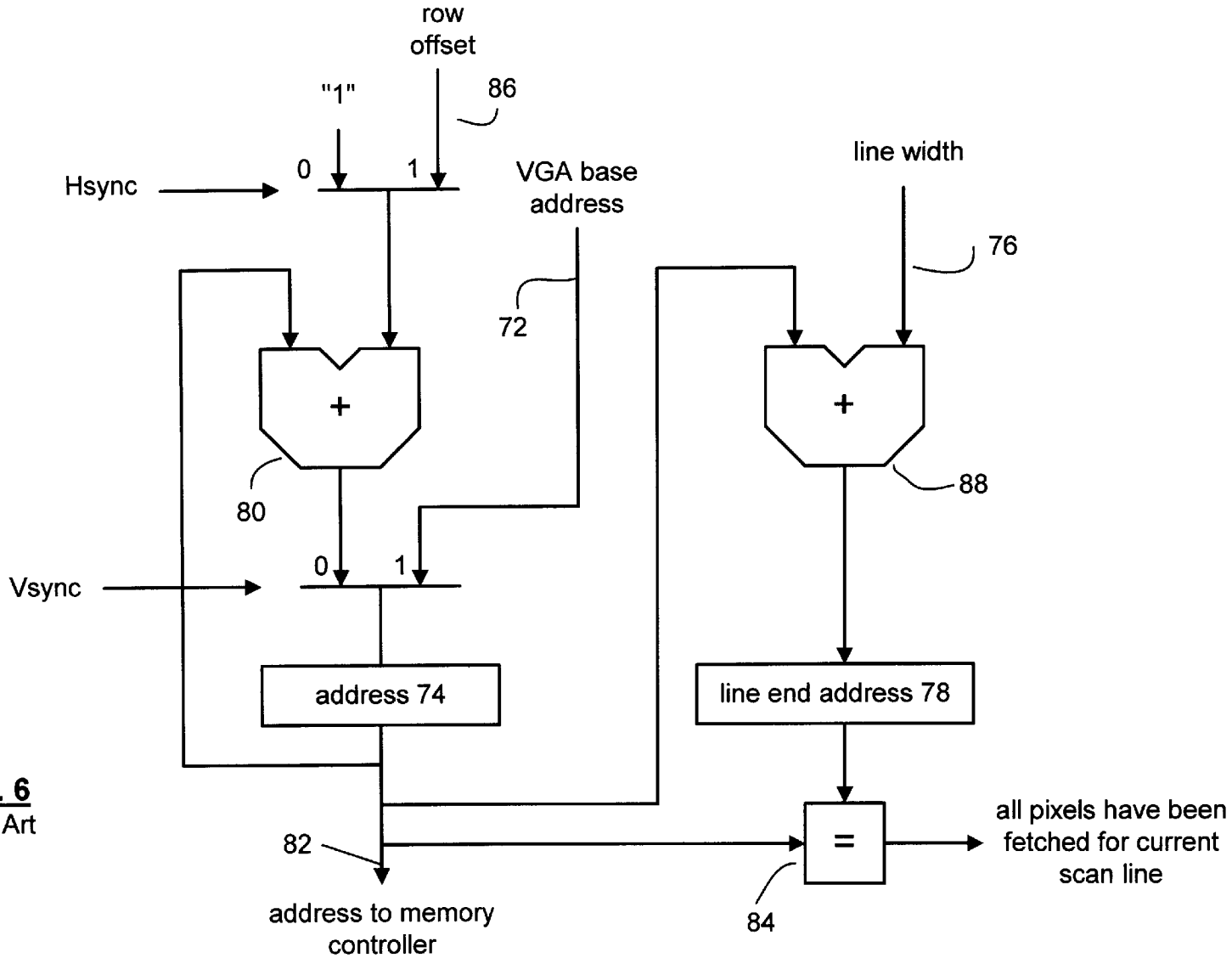
FIG. 6 Prior Art
FIG. 6 is a schematic functional block diagram of a prior art means for fetching pixel information.

Referring now to FIG. 6, a schematic functional block diagram of a prior art system for fetching pixel information and addressing is shown, in which pixel data is fetched from memory on a per scan line basis. At VSYNC (vertical synchronization) time, a VGA starting address or base address 72 is loaded into an address register 74 and an end address or line width 76 is loaded into a line end address register 78. The address in the address register 74 is then incremented using a first adder 80 to generate an address 82 pointing to the memory location from which pixel data is fetched. The address 82 is then incremented and the data fetches continue until the address 82 is equal to the end address stored in the line end address register 78, as determined at logic block 84. At HSYNC (horizontal synchronization) time, an offset 86 is added to the address 82 to point to the data for the next scan line. Also, the new address (i.e. address 82 plus offset 86) in the address register 74 is added to the line width 76 with a second adder 88 to calculate an ending address for the new scan line and loaded into the line end address register 78. The process is then repeated until an entire frame of data has been fetched.

Figure 7A:
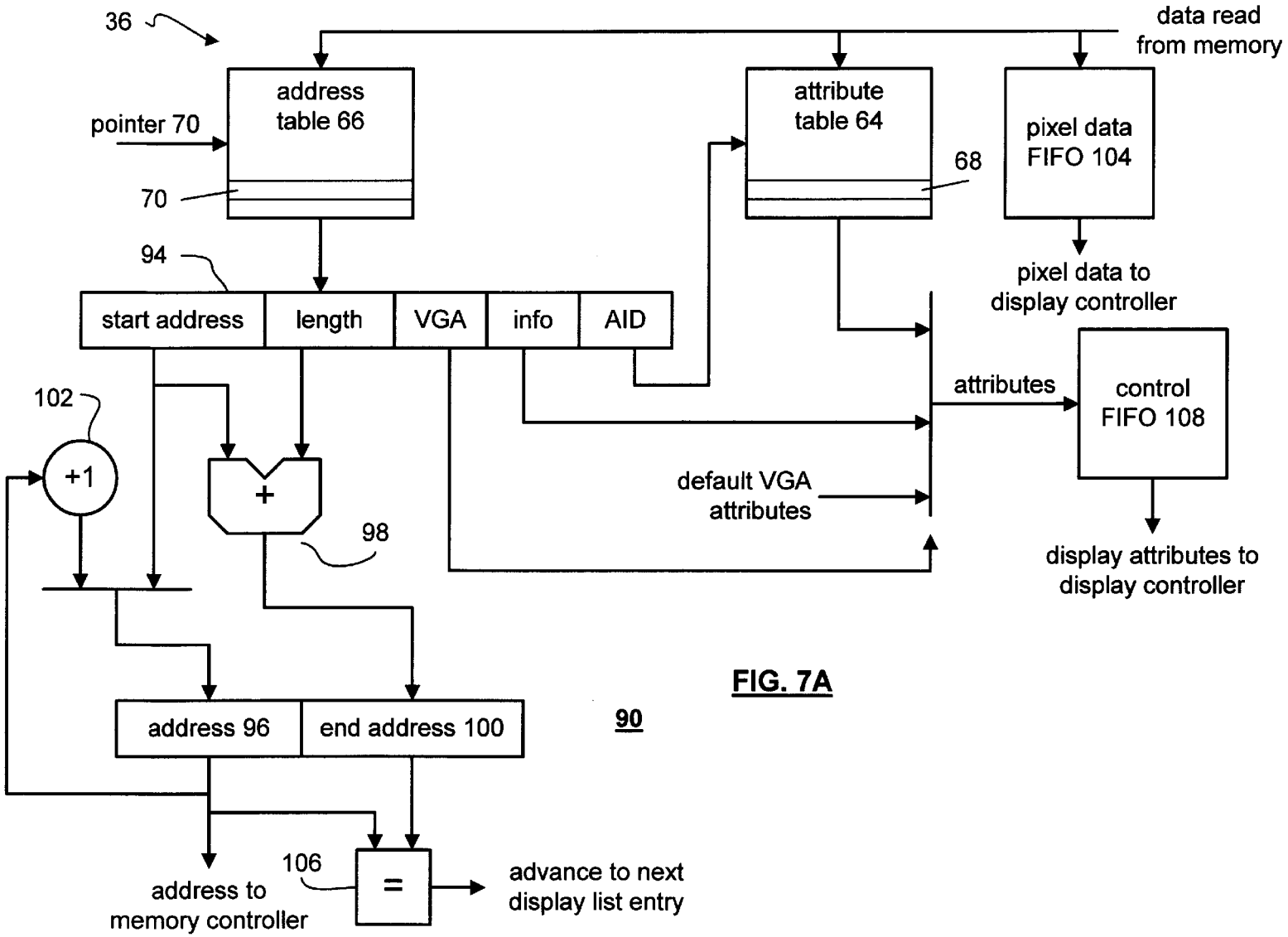
FIG. 7A is a schematic functional block diagram of a means for fetching pixel information in accordance with a first embodiment of the present invention.

FIG. 7A is a schematic functional block diagram of a means for fetching pixel information 90 in accordance with a first embodiment of the present invention. The means for fetching pixel information 90 includes the display list 36 comprising the attribute table 64 and the address table 66. The address table 66 and the attribute table 64 both filled or loaded with data read from a memory (not shown) on a graphics controller chip, a memory associated with the graphics controller chip, such as a video RAM, a memory associated with a host processor, or the like at the beginning of a frame. An address table pointer 92 points to the address table entry 70, preferably using a first-in-first-out (FIFO) algorithm. Accordingly, additional address table entries 70 are read from the memory into the address table 66 as space becomes available in the FIFO, and so on, until the beginning of the next frame. In the presently preferred embodiment, the attribute table 64 is filled only once per frame.

The current address table entry 70 is read into a register 94. In this embodiment, the address table entry 70 specifies a start address, a span length, a pointer into the attribute table 64, and some control information. The start address points to the first memory location where a block of pixel information is stored and the span length specifies the size of the block of pixel information. The start address is loaded into an address register 96 and an end address is calculated by adding the start address and the span length in the register 94 with an adder 98. The end address is then loaded into an end address register 100. The block of pixel information is then read from the video RAM (not shown) using the address in the address register 96 into a memory 104, such as a local RAM. The pixel information is read from sequential memory locations of the defined block by incrementing the address in the address register 96 with an incrementer 102, until the entire block of pixel information has been read. In the presently preferred embodiment, the pixel information is read into and out of the memory 104 using a FIFO algorithm. The pixel information read out of the memory 104 is transferred to the video block or display controller 44 (see FIG. 8), which formats the pixel information using information provided from the attribute table 64 and the control information in the register 94. A logic block 106 compares the address in the address register 96 with the end address 100 to determine when the present block of pixel information has been read, at which time the address table pointer 92 is incremented and the next address table entry 70 is read into the register 94.

The address table entry 70 read into the register 94, in addition to specifying the size and location of the block of pixel information, also includes a pointer, indicated as "AID", into the attribute table 64. As previously discussed, an attribute table entry 68 defines the format of the pixel data 38 being read so that the display controller 44 can properly convert and format the pixel data 38 so that it can be displayed on the display screen 18. In the presently preferred embodiment, the address table entry 70 also includes a "VGA" bit which, if set, notifies the display controller 44 to use standard default VGA attributes, as are known to those of ordinary skill in the art. If the VGA bit is not set, the video block or display controller 44 uses the control information specified in the attribute table 64 to translate the pixel data 38. The attribute table 64 is thus addressed using the AID field. The attribute table entry 68 specified by the AID field or the default VGA attributes are then read into a control memory 108, which in the presently preferred embodiment is written using a FIFO algorithm. The control information in the control memory 108, which includes information such as the data type, the number of bits per pixel, and information required to describe how to display data on the display screen 18, is then passed to the display controller 44. As is known by those of ordinary skill in the art, more pixel information is provided than is necessary to paint a single screen, in order to allow for example, for panning. Accordingly, the control memory 108 also specifies which pixel data is not necessary or will not be displayed on the screen 18.

Figure 7B:
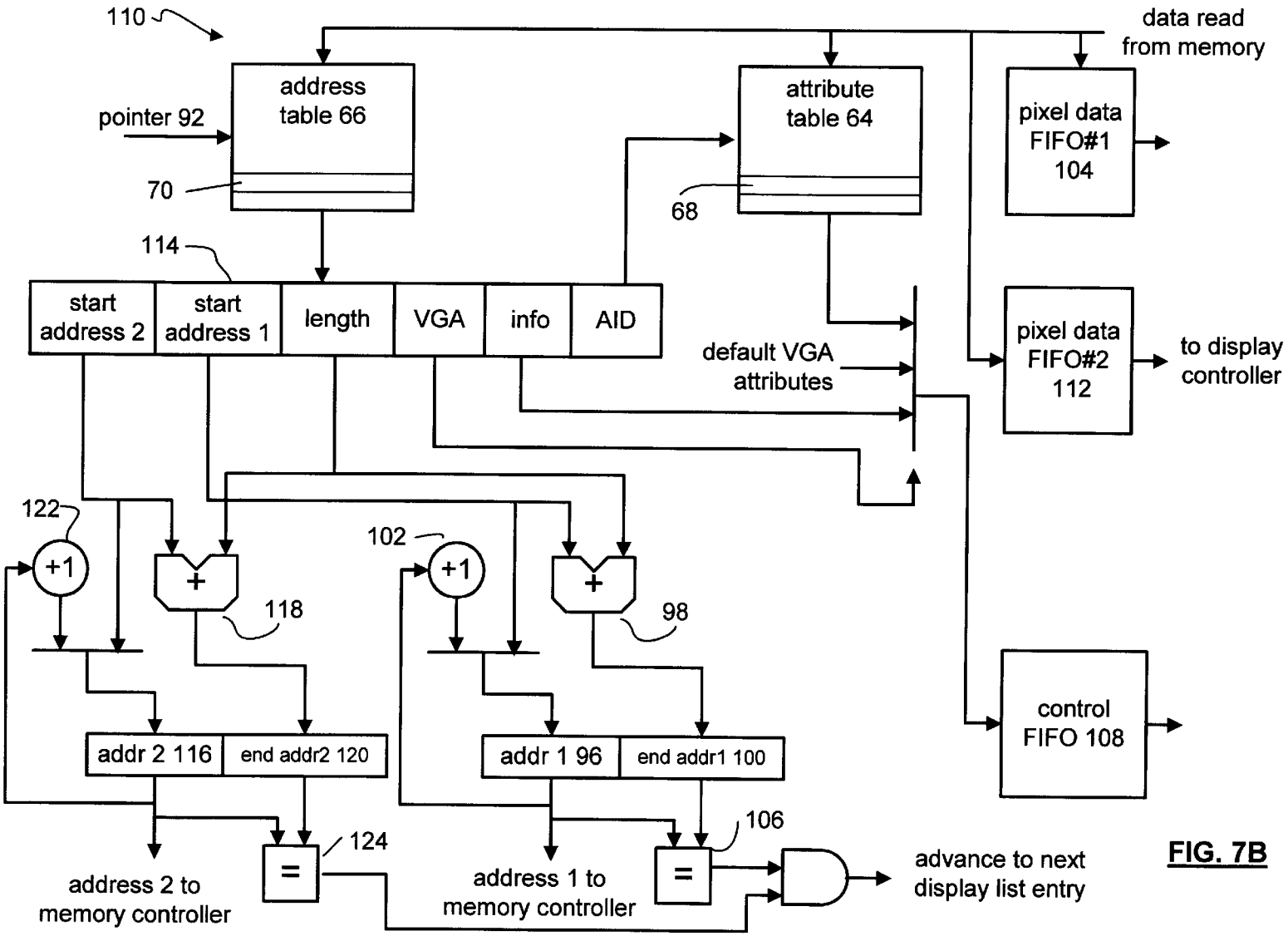
FIG. 7B is a schematic functional block diagram of a means for fetching pixel information in accordance with a second embodiment of the present invention.

FIG. 7B is a schematic functional block diagram of a means for fetching pixel information 110 in accordance with a second embodiment of the present invention. This embodiment expands upon the previous embodiment shown in FIG. 7A in that each display list address table entry 70 specifies two related blocks of pixel data, and thus, a second pixel data memory 112 is also included. The second pixel data memory 112 is also preferably accessed using a FIFO algorithm. The display controller 44 (FIG. 8) then uses the data from both of the pixel data memories 104, 112 to produce each pixel displayed on the screen 18. Like the first embodiment 90, the means for fetching pixel information 110 includes a display list 36 comprising an attribute table 64 and an address table 66, which are both filled or loaded with data read from a memory, such as a video RAM (not shown) at the beginning of a frame. The address table pointer 92 points to the address table entry 70. Address table entries 70 are stored in the address table 66 preferably using a FIFO algorithm, with additional address table entries 70 being read from the memory into the address table 66 as space becomes available, and so on, until the beginning of the next frame. Whereas the attribute table 64 is filled only once per frame.

The current address table entry 70is read into a register 114. In this embodiment, the address table entry 70 specifies two start addresses, a span length, a pointer into the attribute table 64, and some control information. Each start address points to a first respective memory location where a block of pixel information is stored and the span length specifies the size of the two blocks of pixel information. The start addresses are loaded into respective address registers 96, 116 and respective end addresses are calculated by adding each of the start addresses 96, 116 and the span length in the register 114 with adders 98, 118, respectively. The end addresses are then loaded into respective end address registers 100, 120. The two addresses 96, 116 are then used to point to two separate blocks of pixel information in the video RAM (not shown). Each block is then read from the video RAM, sequentially, using the respective addresses in the address registers 96, 116, which are incremented using incrementers 102, 122 into respective memories 104, 112. In the presently preferred embodiment, the pixel information is read into and out of the memories 104, 112 using a FIFO algorithm. The pixel information read out of the memories 104, 112 is transferred to the display controller 44, which formats the pixel information using information provided from the attribute table 64 and the control information in the register 114. Logic blocks 106, 124 compare the addresses in the address registers 96, 116 with the end addresses 100, 120 to determine when all of the data in the two blocks of pixel information have been read. The signals generated by each of the logic blocks 106, 124 are ANDed together using an AND gate 125 to generate a signal which indicates to increment the address table pointer 92 so that the next address table entry 70 is read into the register 114. It should be noted that FIG. 7B is only a schematic functional block diagram of an embodiment for implementing the means for fetching/addressing pixel data and that other implementations are possible. For instance, since, in the presently preferred embodiment, the span length for each pixel data stream is the same, only one end address need be calculated to determine when the entire block of pixel data has been read, and thus, the adder 118, the logic block 124 and the AND gate 124 may not be necessary. In addition, it will be recognized by those of ordinary skill in the art that there are other ways of specifying a start address and an end address in a table entry for a block of pixel information. Accordingly, the present invention is not meant to be limited to the specific embodiment disclosed herein.

As with the first embodiment 90, the address table entry 70 read into the register 114, in addition to specifying the size and location of the block of pixel information, also includes a pointer, indicated as "AID", into the attribute table 64. As previously discussed, the attribute table entry 68 defines the format of the pixel information being read so that the display controller 44 can properly convert and format the pixel information for display on the screen 18. The "VGA" bit in the address table entry 70 specifies whether standard default VGA attributes or attributes specified in the attribute table 64 are to be used to translate the pixel information. Thus, the AID bit serves as a pointer into the attribute table 64. The selected attribute table entry 68 is read into a control memory 108, which in the presently preferred embodiment is written using a FIFO algorithm. The attribute data in the control memory 108 is passed to the display controller 44, along with the pixel data in the first and second pixel data memories 104, 112.

From the foregoing description, it will be apparent to those of ordinary skill in the art that the display list architecture is scalable, and that more than two blocks of pixel information could be specified by a single address table entry 70 and that more than two pixel data memories could be provided. Thus, although FIG. 7B shows two streams of pixel data being fetched from a memory, the invention is not meant to be limited to only providing two streams of pixel data. In addition, although the address table entry 70 is shown as specifying only a single length for two blocks of pixel data, a separate length could be provided for each block of pixel data specified in the address table entry 70. In addition, the pointer 92 of the address table 66 has been described as incrementing sequentially through the address table 66 in a circular manner. However, the pointer 92 is not limited to moving sequentially, but could itself be specified or defined by another display list 36, such that there is a hierarchical structure. With multiple display lists, there is a list entry which allows the lists to be accessed in a manner defined by another list, i.e. a display list acts as a sequencer of the pointer 92. Thus, it will be apparent to those of ordinary skill in the art that the display list architecture allows for nesting of display lists.

Figure 8:
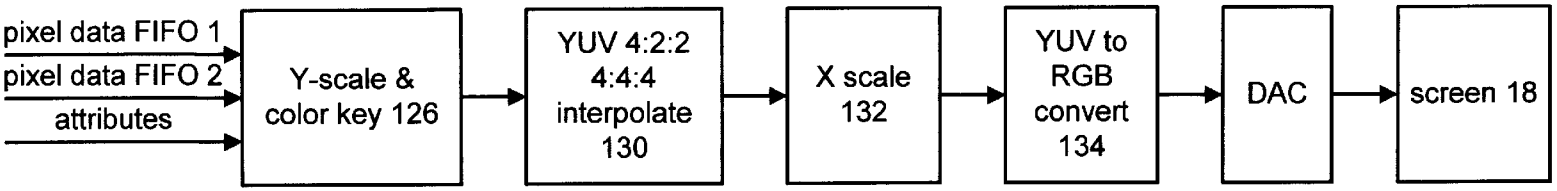
FIG. 8 is a schematic functional block diagram of a means for interpreting video information in accordance with a preferred embodiment of the present invention.
Figure 9A:
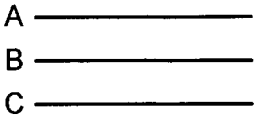
FIG. 9A is a schematic diagram showing three scan lines of information.
Figure 9B:
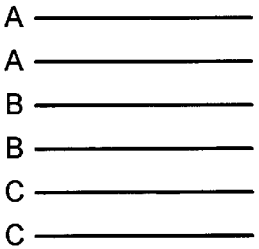
FIG. 9B is a schematic diagram showing how the three scan lines of FIG. 9A are expanded in accordance with a prior art method of scaling display information.
Figure 9A:
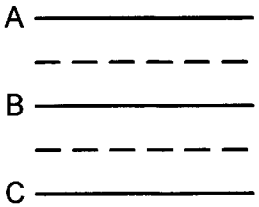

Referring now to FIG. 8, a schematic functional block diagram of the display controller 44 for interpreting video information is shown. The present invention allows various pixel depths, pixel formats, row offsets and scale factors to be intermixed and simultaneously displayed. The display controller 44 provides pixel format conversion, color space conversion, and scaling of the frame buffer pixel data before the data is presented to the DAC block 46. The display controller 44 comprises a first logic block 126 for performing Y-scaling and color keying. Y-scaling is a means for stretching an image in a vertical direction (i.e. the Y direction). In the past, Y-scaling was typically performed by replicating pixels. Referring to FIG. 9A, three separate scan lines of information are shown as A, B and C, with no Y-scaling performed. FIG. 9B shows a prior art method of performing Y-scaling by replicating the pixels in each of the scan lines A, B and C in a predetermined manner such that scan line A is displayed twice, then scan line B is displayed twice, and then scan line C is displayed twice. Although this method of Y-scaling is adequate, it is merely a mechanical way of stretching the image. FIG. 9C shows an improved method of performing Y-scaling according to the present invention. In FIG. 9C, the scan lines A, B and C are no longer just replicated, but rather, adjacent scan lines are compared to each other and a new scan line is generated by comparing the value of the pixels in the adjacent scan lines. For example, new scan line Y1 is generated by calculating a weighted average of the individual pixels of scan lines A and B and new scan line Y2 is generated by calculating a weighted average of the individual pixels of scan lines B and C. Thus, new scan lines Y1 and Y2 represent a more realistic view of the displayed image. Although FIG. 9C depicts a 1:2 ratio, the present invention can stretch an image further according to different ratios, such as 5:8 or 3:17, again by using a weighted average of the known pixel values. For this reason, interpolating the pixel values of the known scan lines is not conducted using a straight average, but rather a weighted average is used. The present invention specifies a Y-scale factor in each attribute table entry 68.

Figure 10:
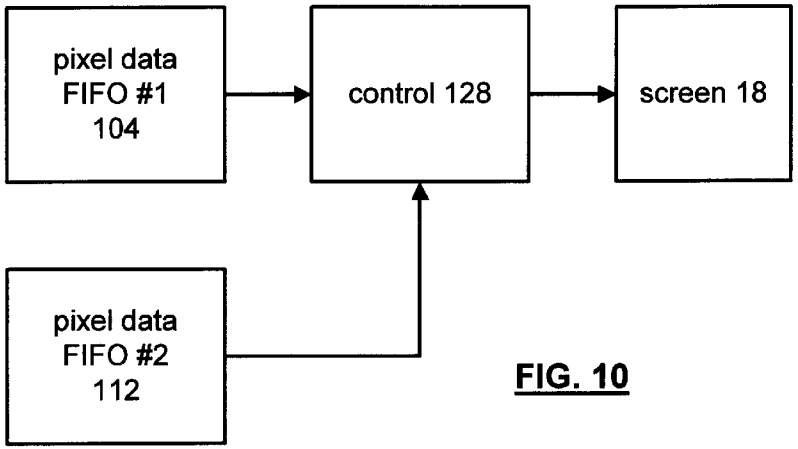
FIG. 10 is a schematic functional block diagram of a portion of a video controller in accordance with a preferred embodiment of the present invention.

Color keying enables an image to be displayed where the source of pixel data can be selected on a pixel by pixel basis between a main or background image and an overlay image. That is, color-keying allows for a transparent overlay of one image over a second image. In order to implement color-keying, the start address of an address table entry 70 is used to specify or point to the overlay image and a Y-scale offset is provided which points to the main or background image. FIG. 10 shows an example of a schematic functional block diagram of a portion of a video controller implementing color-keying. In FIG. 10, two streams of pixel data are stored in the pixel data memories 104, 112. The pixel data is read from each of the memories 104, 112, and pixel mixing logic, shown at control block 128, selects which pixel data is to be displayed on the screen 18. That is, the pixel information for the overlay image is examined to determine if the overlay image pixel information matches the main image pixel information by the pixel mixing logic block 128. If the pixel information of the overlay image matches the pixel information of the main image, the main image is displayed on the screen 18, otherwise, the pixel information from the main image is ignored or discarded and the pixel information for the overlay image is displayed. The pixel mixing logic 128 is configured using three bits which enable comparison with three respective bytes of the main image pixel with the color-keys. If each of the enabled color components matches its respective color-key, then the main image pixel information matches the overlay image pixel information and the main image is displayed on the screen 18. Conversely, if one or more of the enabled color components does not match its respective color-key, then the main image pixel information does not match the overlay image pixel information and the overlay image is displayed on the screen 18. Although FIG. 10 shows the use of two separate data streams of pixel information, the present invention is capable of providing greater than two pixel data streams simultaneously. Moreover, the use of two or more data streams of pixel information is not limited to implementing transparent overlay of an image over a background image, but can also be used, for example, to implement alpha blending or translucent blending, in which a displayed pixel is not a scaled representation, but an interpolated value.

After performing Y-scaling and color-keying at block 126, the display controller 44 performs YUV422 to YUV444 interpolation at block 130. YUV422 to YUV444 interpolation is well known to those of ordinary skill in the art and need not be described in detail for a complete understanding of the present invention. After the interpolation step at block 130, the display controller 44 performs X-scaling at block 132. X-scaling is performed in the same manner as the Y-scaling is performed, i.e. a weighted average of known pixel values is used to determine additional pixel data. In performing X-scaling, since the pixels being used to calculate the weighted average are on the same scan line, two or more pixel data streams are not required for X-scaling. Although, the present invention implements X-scaling using the aforedescribed weighted average method, it will be apparent to those of ordinary skill in the art that the data replication method could also be used to perform X-scaling. In the presently preferred embodiment, an X-scale factor is specified in each attribute table entry 68 in order to determine the amount of scaling to be performed and how the weighted average is calculated.

After X-scaling, the display controller 44 converts pixel information which is in YUV format to RGB format at block 134. In the present invention, input formats YUV422 and YUV444 are converted to RGB888 according to the following formulas:

$$R=aY+bU+cV+wt1;$$

$$G=Dy+eU+fV+wt2;$$

and $$B=gY+hU+jV+wt3;$$

where a, b, c, d, e, f, g, h and j are variables and wt1, wt2 and wt3 are weighting values. In the presently preferred embodiment, a=d=g=1.0, b=j=0.0, c=1.371, e=(−0.338), f=(−0.689), h=1.732, wt1=175.45, wt2=132.56, and wt3=221.75. However, specific variables and conversion factors may vary. Since conversion methods are generally known to those of ordinary skill in the art for converting YUV data to RGB data, further details of YUV to RGB conversion are not necessary for a complete understanding of the present invention.

Finally, in order to display an image on the screen or video monitor 18, the converted pixel information is converted to an analog signal at the DAC block 46. The DAC block 46 is also well known in the art and a detailed description is not required for a complete understanding of the invention.

Figure 5A:
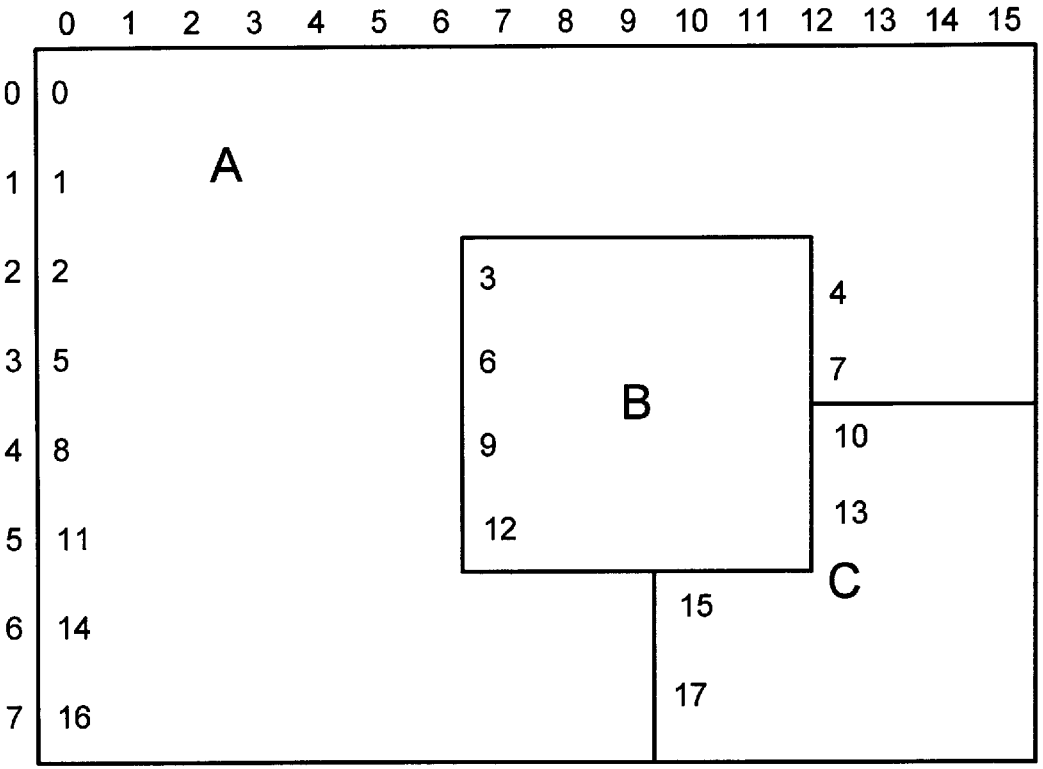
FIG. 5A is a schematic diagram of a portion of a video monitor having three separate windows displayed thereon.

In order to clearly show how the display list 36 operates, an example of a display list 36 for simultaneously displaying three windows, denoted A, B and C, on a portion of a video monitor 140 is shown in FIGS. 5A, 5B and 5C. FIG. 5A is a schematic diagram of a portion of the video monitor 140 having the three separate windows A, B and C displayed thereon. For simplicity, the portion of the video monitor 140 shown has eight (8) horizontal scan lines, each of which is sixteen (16) pixels wide. Of course, video monitors used with the present invention are generally much larger, typically on the order of 480 horizontal scan lines by 640 pixels wide, although it will be apparent to those of skill in the art that the present invention is not limited to video monitors of any particular size or resolution. The numbers (0–17) shown within the display windows A, B, C are used to represent the start of a span length, as described in more detail below.

FIG. 5B is a schematic diagram of an attribute list 142 defining how the pixel data of the three individual windows A, B, C is displayed on the portion of the video monitor 140 and FIG. 5C is a schematic diagram of an address or span table 144 defining the memory location of the pixel data displayed in the three individual windows A, B, C shown on the portion of the video monitor 140 of FIG. 5A.

In the example of FIGS. 5A, 5B and 5C, windows B and C overlap window A, and window B overlaps a portion of window C. Since there are three windows A, B, C, there are three attribute table entries 146*a*, 146*b* and 146*c*. Each window A, B, C is assigned an attribute identity (AID) 148 of 0, 1 and 2, respectively.

In the attribute list 142 (FIG. 5B), DTP, denoted 150, stands for data type (e.g., RGB, YUV, grayscale, etc.); BPP, denoted 152, stands for bits per pixel, with 0 representing 8 bpp, 1 representing 16 bpp, and 2 representing 24 bpp; and YSF, denoted 154, and XSF, denoted 156, stand for Y-scale factor and X-scale factor, respectively.

In the span table 144 (FIG. 5C), span entry 158 indicates the span table entry number, which corresponds to the numbers (0–17) shown within the display windows A, B, C of the screen 140. LSA, denoted 160, represents the linear start address in memory, VGA, denoted 162, indicates whether the pixel data is VGA compatible data. If the pixel data is VGA compatible, then default VGA attributes are used by the display controller 44 to process the pixel data. OFS, denoted 164, represents an offset between a first starting address and a second starting address for fetching more than one pixel data stream. In the presently preferred embodiment, the offset between two starting addresses is calculated using the formula: $address_1=address_0+2^{OFS+3}$. For example, if OFS=5 for address 0, then the distance between address 0 and address 1 is calculated as ($address_0+2^{5+3}$). SL, denoted 166, represents the span length.

In the example, window A is an unscaled, 8 bits per pixel (bpp) indexed color, and is designated VGA compatible. In the frame buffer (not shown), window A has a base address of 0 with a pitch of 32 bytes. Window B is 24 bpp RGB with 2× magnification in both the X and Y dimensions and has a frame buffer base address of 256 with a pitch of 16 bytes. Window C is unscaled, 16 bpp YUV422 and has a frame buffer base address of 1024 and a pitch of 256 bytes.

Referring now to FIG. 5B, the attribute list entry 146*a* has an AID of 0, DTP of 0, BPP of 0 (8 bpp), and YSF and XSF are 0 (i.e. unscaled). Attribute list entry 146*b* has an AID of 1, DTP of 1, BPP of 2 (24 bpp), and YSF and XSF are 0×400 (for 2× magnification). Attribute list entry 146*c* has an AID of 2, DTP of 0, BPP of 1 (16 bpp), and YSF and XSF are 0 (unscaled).

Reviewing the span table entries of FIG. 5C and the display windows A, B, C shown in FIG. 5A, window A is defined by span table entries 0, 1, 2, 4, 5, 7, 8, 11, 14 and 16. Therefore, for each of these span table entries (0, 1, 2, 4, 5, 7, 8, 11, 14, 16), AID=0, VGA=1 (since window A is VGA compatible), and OFS=0. OFS=0 because window A is unscaled and is VGA compatible, therefore a second pixel data stream is not necessary. For span table entry 0, the LSA is 0 (the base address for window A is defined as 0) and the span length SL is 15, since only window A is displayed on line 0 of the video monitor 140 (16 pixels wide). For span table entry 1, the LSA is 32 because the pitch for window A is 32 (base address 0 plus 32), and SL is again 15, since only window A is displayed on line 1. However, for span table entry 2, only a portion of window A is shown, before window B overlies window A. Accordingly, although the LSA is 64 (32 plus 32), the span length SL is only 5 (for 6 pixels). Similarly, span table entry 4 describes only a portion of a scan line displaying window A, thus, LSA is 76 (the address for pixel 12 if scan line 2 were not interrupted by window B) and the span length is 3 (i.e., specifying 4 pixels). The remaining span table entries, 5, 7, 8, 11, 14, 16 for window A are similarly defined.

Window B is defined by span table entries 3, 6, 9 and 12. Therefore, for each of these span table entries (3, 6, 9, 12), AID=1, VGA=0 (since window B is not VGA compatible), and OFS=1, because the window is Y-scaled, two pixel data streams are fetched. Since no other windows overlay window B and window B is rectangular, the span length SL for each span table entry 3, 6, 9 and 12 is 8 (to display 6 pixels using 2:1 scaling, 3 pixels are fetched, with each pixel defined as 24 bpp). The LSA for span table entry 3 is 256, which is the starting address for window B. Since window B is Y-scaled 1:2, the pixel data information is fetched twice (note span entries 3 and 6 have the same LSA and span entries 9 and 12 have the same LSA), with different weightings then being used to calculate the window B pixels displayed on the screen.

Window C is defined by span table entries 10, 13, 15 and 17. Therefore, for each of these span table entries (10, 13, 15, 17), AID=2, VGA=0 (since window C is not VGA compatible), and OFS=0, because window C is not scaled, and therefore, a second pixel data stream is not fetched. Note that window B overlies window C on scan lines 4 and 5. Thus, scan table entries 10 and 13 vary from scan table entries 15 and 17, as described below. The span length SL for span table entries 10 and 13 and the span length for span table entries 15 and 17 is 13. Note that although the starting address for window C is defined as 1024, the LSA for span table entry 10 is 1028 (1024 plus 4), since window B partially overlies window C. Similarly, the LSA for span table entry 13 is 1284 (1024 plus 256 plus 4). Whereas the LSA for span table entries 15 and 17 is 1536 and 1792, respectively. Note that if window B (or any other window) did not partially overlie window C, the LSA for span table entries 10, 13, 15 and 17 would be 1024, 1280, 1536 and 1792 (each increasing by 256, which is the predefined pitch for window C).

From the foregoing description and example, it can be seen that the present invention comprises a method and apparatus for displaying pixels on a display screen, and more particularly, to a method and apparatus for simultaneously displaying multiple windows of varying types on a display screen. It will further be understood that the pixel data displayed need not be stored in sequential memory locations, but that the pixel data may be stored in non-sequential blocks of memory which is accessed by way of a linked list. It will also be recognized by those skilled in the art that changes may be made to the above-described embodiments of the invention, for instance to the layout or format of the display list and the predefined fields of the display list, without departing from the inventive concepts thereof. The display list architecture provides the ability to address a plurality of objects, where the objects are different windows. Other applications, for example, could be for texture mapping, buffering, monitor identities (i.e. a plurality of images for a respective plurality of interconnected monitors could be stored and accessed using the display list architecture), and teleconferencing. It is understood, therefore, that this invention is not limited to the particular embodiments disclosed but is intended to cover all modifications which are within the scope and spirit of the invention as defined by the appended claims.

We claim:

1. An apparatus for displaying multiple windows of visual information on a video monitor comprises:

a control logic module;

memory operably coupled to the control logic module, wherein the memory stores operational instructions that cause the control logic module to (a) receive an address pointer from a first memory block and a second memory block and attribute information from the first memory block, wherein the first memory block includes a plurality of display list entries that include a starting address, a span length, and attribute information and wherein the second memory block includes randomly located pixel data; (b) retrieve a data block from the second memory block in accordance with the address pointer and the attribute information; (c) process the address pointer and the attribute information to interpret the pixel data read from the memory as specified by the display list entry in accordance with the attribute information; and (d) provide the interpreted pixel data to a display controller, wherein the interpreted pixel data can be intermixed and simultaneously displayed on a display screen;

the display controller, operably coupled to the control logic module, to provide pixel format conversion, color space conversion, and scaling of frame buffer pixel data; and a digital-to-analog converter module, operably coupled to the display controller and the display screen, to convert the pixel format conversion, color space conversion, and scaling of frame buffer pixel data to analog signals to be displayed on the display screen.

2. The apparatus of claim 1, wherein the address pointer is incremented to access a next memory location of pixel data, until the address pointer is equal to a sum of the start address and the span length.

3. The apparatus of claim 1, wherein the starting address specifies the starting address of a block of the pixel data to be read from any location within the memory.

4. The apparatus of claim 1, wherein the span length specifies the size or length of the block of the pixel data which begins at the starting address.

5. The apparatus of claim 1, wherein the attribute information specifies the manner in which the block of pixel data defined by the starting address and the span length is to be interpreted or processed prior to being displayed on the display screen.

6. The apparatus of claim 1, wherein the pixel data includes various pixel depths, pixel formats, row offsets, scale factors, and information on which display list entry to use.

7. The apparatus of claim 1, wherein the display controller comprises:

a first module, operably coupled to receive pixel data and attribute information, for performing Y-scaling and color keying on the pixel data and attribute information;

a second module, operably coupled to the first module, for performing YUV422 to YUV444 interpolation;

a third module, operably coupled to the second module, for performing X-scaling; and a fourth module, operably coupled to the third module and the digital-to-analog converter module, for performing YUV to RGB conversion.

8. The apparatus of claim 7, wherein the performing of Y-scaling and X-scaling further comprises a plurality of scan lines that are compared to each other to generate a new scan line between adjacent scan lines by calculating the weighted average of individual pixels in the adjacent scan lines.

9. The apparatus of claim 7, wherein the color keying further comprises a start address of an address table entry that is used to point to an overlay image and a Y-scale offset that is provided which points to a main image or background image, wherein the main image is displayed if the pixel information of the overlay image matches the pixel information of the main image and, the overlay image is displayed if the pixel information of the overlay image does not match the pixel information of the main image.

10. A method for displaying multiple windows of visual information on a video monitor, the method comprises the steps of:

a) receiving, by a control logic module, an address pointer from a first memory block and second memory block and attribute information from the first memory block, wherein the first memory block includes a plurality of display list entries that include a starting address, a span length, and attribute information, and wherein the second memory block includes randomly located pixel data;

b) retrieving, by the control logic module, a data block from the second memory block in accordance with the address pointer and attribute information;

c) processing, by the control logic module, the address pointer and the attribute information to interpret pixel data read from the second memory block as specified by a display list entry in accordance with the attribute information; and d) providing, by the control logic module, the interpreted pixel data to a display controller, wherein the interpreted pixel data can be intermixed and simultaneously displayed on a display screen, e) providing, by the display controller, pixel format conversion, color space conversion, and scaling of frame buffer pixel data;

f) receiving, by a digital-to-analog converter module, the pixel format conversion, color space conversion, and scaling of frame buffer pixel data; and g) converting, by the digital-to-analog converter module, the pixel format conversion, color space conversion, and scaling of frame buffer pixel data, to analog signals to be displayed on a display screen.

11. The method of claim 10, wherein step (a) further comprises:

incrementing the address pointer to access a next memory location of pixel data, until the address pointer is equal to a sum of the start address and the span length.

12. The method of claim 10, wherein step (a) further comprises:

specifying, by the starting address, the starting address of a block of the pixel data to be read from any location within the memory.

13. The method of claim 10, wherein step (a) further comprises:

specifying, by the span length, the size or length of the block of the pixel data which begins at the starting address.

14. The method of claim 10, wherein step (a) further comprises:

specifying, by the attribute information, how the block of pixel data defined by the starting address and the span length is to be interpreted or processed prior to being displayed on the display screen.

15. The method of claim 10, wherein step (a) further comprises:

providing, by the pixel data, various pixel depths, pixel formats, row offsets, scale factors, and information on which display list entry to use.

* * * * *